US007030375B1

(12) United States Patent
Testoni et al.

(10) Patent No.: US 7,030,375 B1
(45) Date of Patent: Apr. 18, 2006

(54) TIME OF FLIGHT ELECTRON DETECTOR

(75) Inventors: Anne L. Testoni, Bolton, MA (US); Gabor Toth, San Jose, CA (US)

(73) Assignee: KLA-Tencor Technologies Corporation, Milpitas, CA (US)

( * ) Notice: Subject to any disclaimer, the term of this patent is extended or adjusted under 35 U.S.C. 154(b) by 19 days.

(21) Appl. No.: 10/836,635

(22) Filed: Apr. 29, 2004

Related U.S. Application Data

(60) Provisional application No. 60/509,734, filed on Oct. 7, 2003.

(51) Int. Cl.
*H01J 49/40* (2006.01)

(52) U.S. Cl. ..... 250/305; 250/309; 250/423 R; 250/287; 315/111.81; 378/34

(58) Field of Classification Search ..... 250/305, 250/309, 423 R, 287; 315/111.81; 378/34
See application file for complete search history.

(56) References Cited

U.S. PATENT DOCUMENTS 6,288,394 B1 * 9/2001 Barnes et al. ..... 250/309
6,545,272 B1 * 4/2003 Kondo ..... 250/305
2004/0211896 A1 * 10/2004 Laprade et al. ..... 250/288

* cited by examiner

*Primary Examiner*—Nikita Wells
*Assistant Examiner*—Zia R. Hashmi
(74) *Attorney, Agent, or Firm*—Beyer Weaver & Thomas LLP

(57) ABSTRACT

Methods and apparatus for determining the material composition of a semiconductor device at an area of interest are described. An electron time-of-flight spectrometer is used within a semiconductor inspection system. The spectrometer is placed on the opposite side of an objective lens from the area of interest. In one embodiment, the electron time-of-flight spectrometer is an electron drift tube. A computing module produces an electron emission spectrum for the materials at the area of interest.

35 Claims, 5 Drawing Sheets

TIME OF FLIGHT ELECTRON DETECTOR

This application claims priority of U.S. provisional patent application No. 60/509,734, filed Oct. 7, 2003, entitled "Time of Flight Electron Detector," which is hereby incorporated by reference.

BACKGROUND OF THE INVENTION

I. Field of the Invention

The present invention relates generally to methods and apparatus for testing semiconductor devices using electron emission spectrometry. More particularly, the present invention relates to using a time of flight electron detector as a device to differentiate electrons based on their energy. This can be utilized to determine the composition of an area of interest on a semiconductor device.

II. Background

The industry of semiconductor manufacturing involves highly complex techniques for integrating circuits into semiconductor materials. Due to the large scale of circuit integration and the decreasing size of semiconductor devices, the semiconductor manufacturing process is prone to processing defects. Testing procedures are therefore critical to maintain quality control. Since the testing procedures are an integral and significant part of the manufacturing process, the semiconductor industry constantly seeks more accurate and efficient testing procedures.

A critical aspect of semiconductor fabrication involves the formation of the multiple conductive layers and liner layers. Each conductive layer includes the metal traces, also referred to as interconnects, which form the paths along which electronic signals travel within semiconductor devices. Dielectric material layers and liner layers separate conductive layers. The dielectric material layer, commonly silicon dioxide, provides electrical insulation between the conductive layers. Portions of each conductive layer are connected to portions of other conductive layers by electrical pathways called "plugs." The liner layers are formed between each conductive layer and each dielectric material layer to prevent the conductive material from diffusing into the dielectric material layer. The liner layer inhibits a conductive layer from diffusing into an underlying dielectric and shorting circuiting with an adjacent conductive layer. Of course, such short circuit formations are likely to be detrimental to semiconductor performance. In particular, copper, a common conductive material used in semiconductor devices, diffuses very aggressively into silicon dioxide. The thickness and composition of the conductive and liner layers must be formed under extremely small margins of error. Thus, systems capable of testing the characteristics of these layers are very important.

Typically, testing of semiconductor devices is performed in two phases. The first phase involves an inspection process and the second phase involves defect review. During the inspection process, potential defects in semiconductor devices are typically detected through die-to-die comparison techniques. This is where similar die areas are compared against each other and differences between die areas are noted as possible defects since the die areas are ideally identical to each other. Due to the relatively low resolution of inspection systems, the actual nature of these potential defects cannot be determined. Therefore, semiconductor devices with potential defects are identified and set aside for the second phase of defect review. During defect review, these potentially defective semiconductor devices are studied more carefully to determine the nature and/or cause of these potential defects.

Some of the techniques that have been used during defect review include Energy Dispersive X-ray Spectroscopy (EDX) and Energy Dispersive Spectrometry (EDS), which can each be used to determine the material composition of an area of interest on a semiconductor device, such as a defect. Specifically, EDX involves exposing the area of interest to a beam of charged particles, which causes the area of interest to emit x-rays characteristic of the materials at the area of interest. A detector is then used to collect a portion of the x-rays to determine the energy spectrum for the collected x-rays, which can be used to identify the materials. The detector is typically positioned adjacent to the area of interest and the beam of charged particles, such that the detector does not interfere with either the area of interest or beam of charged particles. The detector is also positioned below the objective lens, which focuses the charged particle beam onto the area of interest, of the inspection system. However, because of the close proximity between the detector and the area of interest, only a portion of the x-rays can be collected, thereby limiting the amount of information that can be obtained about the area of interest. Specifically, only the x-rays emitted in the direction of the detector will be measured even though x-rays typically are emitted in multiple directions. In order to collect a broader range of the emitted x-rays, either multiple detectors or a single detector repositioned at various locations must be used, both of which can be time-consuming and costly. Even if multiple detectors or a mobile detector is used, many of the x-rays will go undetected, especially those emitted in the direction of the oncoming beam of charged particles. Furthermore, because materials with low atomic numbers disperse few x-rays, the EDX technique does not work well for analyzing some materials.

The EDS technique, as described in more detail below, also involves exposing the area of interest to a beam of charged particles. However, instead of analyzing x-rays emitted by the area of interest, EDS analyzes electrons emitted by the area of interest in response to being exposed to the beam of charged particles. In particular, EDS typically involves applying an electromagnetic field to the emitted electrons, such that the electrons are separated spatially depending on their respective energies. Next, each spatial region of interest is monitored to determine the number of electrons passing through these regions. Based on the number of electrons passing through various spatial regions, an energy spectrum can be obtained for the collected electrons. Because each spatial region is typically analyzed in sequence, EDS can be a time-consuming process. For instance, generating a spectrum for a single area of interest using EDS can take about ten minutes.

Accordingly, conventional systems for obtaining an energy spectrum and determining the composition of an area of interest on a semiconductor device are time-consuming, and can be of limited value, especially when only a portion of the spectrum can be obtained. In view of the foregoing, there are continuing efforts to provide improved methods and apparatus for testing and reviewing semiconductor devices.

SUMMARY OF THE INVENTION

The techniques of the present invention address the above need by providing methods, code and apparatus for determining the material composition of a semiconductor device at a specified location by measuring the time of flight of substantially all of the electrons emitted by the semiconductor device in response to being impinged with a charged particle beam. The techniques involve a spectrometer system wherein a spectrometer is placed above an objective lens such that a large portion of the electrons that emanate from the inspected specimen is fed into the spectrometer.

One aspect of this invention pertains to an apparatus for determining the material composition of a semiconductor device at an area of interest. This apparatus includes at least a charged particle device configured to emit a charged particle beam towards the area of interest such that electrons are caused to emanate from the area of interest, a spectrometer that receives the electrons that emanate from the area of interest, an objective lens positioned between the semiconductor device and the spectrometer, the objective lens configured to attract and collimate the electrons that emanate from the area of interest, and a computing module coupled to the detector, wherein the computing module is configured to determine the energy and intensity of the electrons received by the spectrometer.

In an alternative embodiment, the apparatus includes at least a charged particle device, a redirecting lens that allows the charged particle beam to travel towards the area of interest and that direct electrons that emanate from the area of interest away from the path of the charged particle beam, a drift tube, at least one detector disposed opposite the aperture of the drift tube, and a computing module coupled to the detector.

Another aspect of this invention pertains to a method of determining the material composition of a semiconductor device at an area of interest. This method involves at least emitting a charged particle beam towards an area of interest, directing the electrons that emanate from the area of interest away from the path of the charged particle beam such that the electrons are directed toward a drift tube, receiving the electrons through an aperture of the drift tube, detecting the electrons arriving at a detector disposed opposite the aperture of the drift tube during specified time intervals, calculating a time of flight for each of the electrons arriving at the detector, generating an electron emission spectrum for the electrons from the time of flight calculations, identifying peaks in the electron emission spectrum, and identifying the materials associated with the area of interest from the electron emission spectrum.

These and other features of the present invention will be described in more detail below with reference to the associated figures.

DETAILED DESCRIPTION OF INVENTION

As described above in the Background section, conventional systems for obtaining an energy spectrum and determining the composition of the materials in area of interest on a semiconductor device are time-consuming and can be of limited value. Accordingly, various embodiments of the present invention provide apparatus and methods for determining the material composition of an area of interest on a semiconductor device with improved efficiency. More particularly, according to various embodiments, an area of interest on a semiconductor device is exposed to a charged particle beam and, in response, the electrons emitted by the area of interest are routed via one or more lenses, or the like, through a drift tube having a known length. The amount of time that each of the electrons travels from one end of the drift tube to the other end is measured as the time of flight for each of these electrons. From the time of flight data, an electron emission spectrum can be generated, which shows the intensity levels of electrons having different energy levels. Peaks in the electron emission spectrum indicate that a large number of electrons having a particular energy level were emitted from the area of interest. Because different materials emit electrons having unique energy levels, identifying the energy levels characteristic of the electrons emitted by an unknown material can aid in identifying the composition of the unknown material. More particularly, once peaks in an electron spectrum are identified, the energies corresponding to these peaks are compared to values in standard tables, which can include tables, graphs, charts, indices, and the like, with data for known materials. Materials having electron energies corresponding to these peaks can be identified as materials included in the area of interest. As described in more detail below, the techniques of the present invention allow a higher proportion of the emitted electrons to be analyzed than when conventional techniques are used, thereby allowing a more complete identification of the materials at the area of interest. Furthermore, the techniques of the present invention allow such identification to be made in a shorter period of time than when conventional techniques are used.

Figure 1:
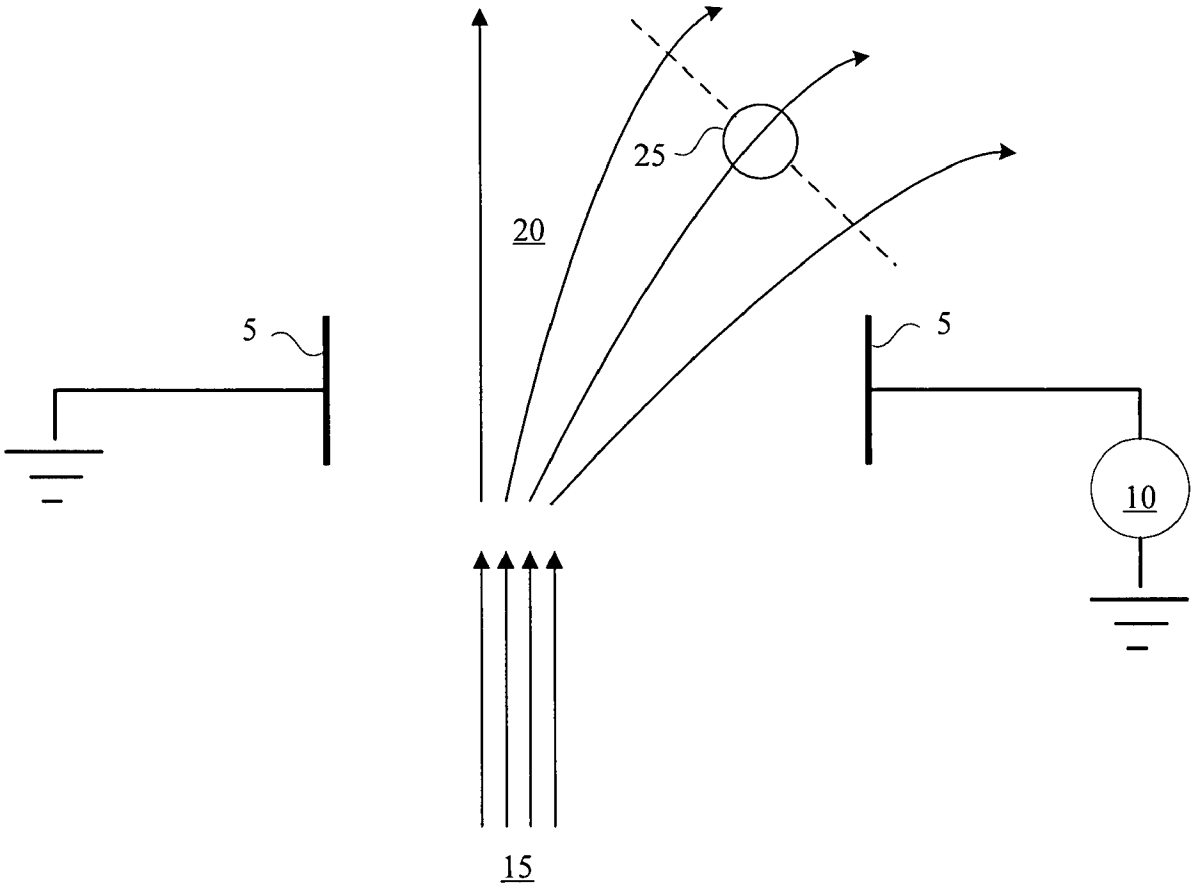
Figure 1 (Prior Art)
FIG. 1 is a diagrammatic representation of a conventional energy dispersive spectrometer system.

Turning now to FIG. 1, shown is a diagrammatic representation of an energy dispersive spectrometer system (EDS) that has been used to determine the composition of a material based on electron emissions from the material, as described above in the Background section. The EDS includes charged surfaces 5, such as parallel plates, a cylinder, hemi-sphere, or the like, which have an electric potential that produces a field in the region between them. The electric potential between the charged surfaces 5 is driven by voltage source 10. Similar arrangement can be made with magnetic fields, which is commonly known as magnetic analyzers.

To identify the material composition of an area of interest on a semiconductor device, the charged surfaces are placed adjacent to the area of interest. The area of interest is then exposed to a beam of charged particles. The beam causes the area of interest to emit electrons, such as Auger electrons, having energies characteristic of the materials that emitted them. A portion of these electrons 15, which are emitted in the direction of the charged surfaces 5, pass through the region between charged surfaces 5. Because this region includes an electrical field, electrons of different energy levels are attracted to a charged surface 5 at varying degrees, thereby causing electrons of different energy levels to separate spatially as they exit the region between the charged surfaces 5. In order to determine the intensity of electrons having various energy levels, the potential difference inside the dispersive system is varied so that only electrons with a specific (narrow) energy range can pass through a small aperture 25 which is placed in front of the electron detector. The electron count over a specified time interval can be translated to the intensity of electrons having a particular energy. From this information, the composition of the material can be determined by identifying which energies correspond to a high intensity of electrons, and which materials correspond to these energies. However, because the field needs to be changed sequentially for different energies to pass the exit region to collect electron counts, this process can be time-consuming. Furthermore, because incoming electrons 15 include only a fraction of the electrons emitted from the sample, only limited information about the material may be obtained. For instance, if some of the materials at the area of interest emit electrons in a different direction than where the charged surfaces 5 are located, they will not be detected by the system. An alternative arrangement is to use a position sensitive detector instead of the aperture and register the spatial distribution of the electrons as they leave the energy dispersive device. The position information then can be translated to energy information. Although the spectrum collection time is considerably faster in this case the energy resolution is often compromised.

Figure 2:
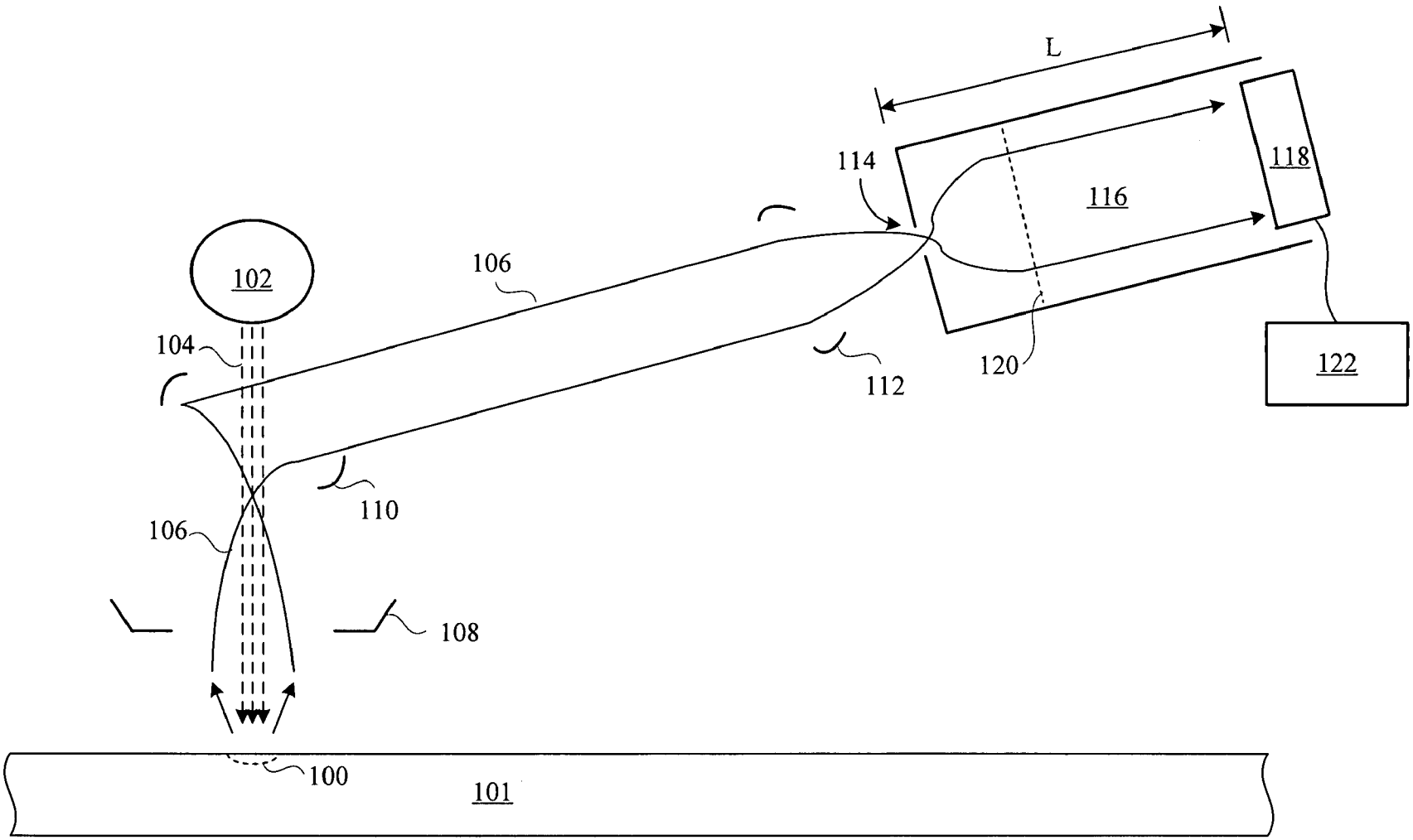
FIG. 2 is a diagrammatic representation of an electron emission spectrometry system according to one embodiment.

With reference to FIG. 2, shown is a diagrammatic representation of an electron emission spectrometer system in accordance with one embodiment of the present invention. This system can be used to identify materials included at an area of interest 100 on a semiconductor device 101. The area of interest 100 can be a defect, irregularity, a non-defective area, or the like, which can take any form such as a protrusion, recess, or the like. The semiconductor device 101 can be a semiconductor wafer, die, or the like, and can include interconnects, deposits, etched portions, and the like, depending upon when, during the fabrication process, the semiconductor device 101 is tested.

The SEM spectrometer system of FIG. 2 is able to collect a large portion of the electrons that emanate from area of interest 100 since the electrons first pass through objective lens 108 and then they pass onto spectrometer 116. In FIG. 2, spectrometer 116 is positioned higher than objective lens 108. In FIG. 2, the spectrometer is a time-of-flight spectrometer 116. Objective lens 108 acts to draw and collimate the electrons that emanate from area of interest 100, which thereby allows the spectrometer system to have high electron collection efficiency. In other words, the spectrometer system uses the high extraction field between the wafer (or semiconductor device 101) and objective lens 108 to collect all secondary electrons and guide them to the spectrometer, which results in a high effective solid angle.

In the present exemplary embodiment, the system includes a charged particle device 102 configured to emit a charged particle beam 104 towards area of interest 100. The charged particle beam 104 can be emitted continuously or in short pulses, as described in more detail below. When directed towards area of interest 100, the charged particle beam 104 can pass through lenses, such as redirecting lens 110 and objective lens 108, before reaching area of interest 100. Although redirecting lens 110 is positioned in the path of the charged particle beam 104, the charged particle beam 104 can pass through redirecting lens 110 without substantial alteration. Redirecting lens 110 can be, for example, a Wien filter or a triple-deflector. Objective lens 108 can be an image-forming lens used to direct the charged particle beam towards the area of interest. Although the primary function of the objective lens is probe formation it also affects the collimation of the upcoming secondary electron beam, hence it is part of the secondary optics as well.

Once the charged particle beam 104 reaches area of interest 100, the charged particle beam 104 can cause area of interest 100 to emit electrons 106, such as Auger electrons, or the like. The emitted electrons 106 can have energies in the range of about 0 eV to the landing energy of the primary beam. In one implementation the beam 104 causes electrons to emanate from the area of interest having energies in the range of about 0 eV to about 35000 eV.

The electrons 106 emitted by area of interest 100 can then pass through objective lens 108, which can be placed in the path of both the charged particle beam 104 and a wide spectrum of electrons 106 emitted from area of interest 100. Preferably, substantially all of the electrons 106 emitted from area of interest 100 will pass through objective lens 108. It is generally achieved by placing the lens at a more positive potential than the substrate itself. For example, if the area of interest 100 has an electric potential of −4 kV and objective lens 108 has an electric potential of −2 kV, the emitted electrons 106 will be more attracted to objective lens 108 than area of interest 100. The purpose of such accelerating field for the secondary electrons is to form a collimated beam with minimal loss of signal. In some embodiments, objective lens 108 includes a combination magnetic and electrostatic lens configured to generate an electrostatic field pointing towards the surface of the substrate.

Once the electrons 106 reach objective lens 108, objective lens 108 can direct these electrons 106 towards redirecting lens 110. As described above, redirecting lens 110, which is disposed in the path of charged particle beam 104, does not substantially interfere with charged particle beam 104 when directed towards area of interest 100. However, redirecting lens 110 can direct electrons 106 from objective lens 108 towards focusing lens 112, or the like, which is disposed away from the path of the charged particle beam 104. Redirecting lens 110 can be a Wien filter, a triple magnetic/electrostatic deflector, or the like. The placement of redirecting lens 110 with relation to objective lens 108 has no particular significance but it is generally desired to exit the upcoming secondary beam before other multipole lenses in the system, such as scanning and stigmation fields, substantially affect it. The design goal is to minimize electron loss in the upcoming path and retain all of the timing information carried by the secondary electrons.

Once the electrons 106 reach focusing lens 112, focusing lens 112 can direct the electrons 106 towards drift tube 116. More particularly, focusing lens 112 can direct the electrons 106 through an aperture 114 of drift tube 116, which is an opening in the drift tube having a diameter that is smaller than the diameter of the drift tube 116 and which is configured to receive the electrons 106. Small apertures 114 help to define the boundaries of the subsequent decelerating field, which produces a uniform, collimated beam of slow-moving electrons along the drift tube. Focusing lens 112 can be an Einzel lens, or the like, and can be considered part of or separate from drift tube 116, depending on the desired application.

The drift tube can have a length L and in some embodiments, the drift tube 116 can be substantially field-free. In other embodiments, a negative voltage grid 120 can be placed within drift tube 116 to slow down and/or focus electrons passing through the drift tube region. For instance, negative voltage grid 120 can be used to focus the electrons 106 toward a detector 118 positioned at or near the end of the drift tube 116 and opposite the aperture 114. Negative voltage grid 120 can be constructed of parallel plates, a cylindrical section, or the like, that can create a negative field sufficient to slow down and/or focus the electrons 106.

As mentioned, a detector 118 can be positioned at or near the end of drift tube 116 and opposite the aperture 114. The detector 118 can be configured to detect electrons 106 arriving at the detector 118. In addition, detector 118 can be coupled to a computing module 122, which can count the number of electrons 106 arriving at the detector 118 during specified time intervals, such that the time of flight for each of the electrons passing through the drift tube 116 can be calculated to produce an electron emission spectrum for the materials at the location of interest 100, as described below in more detail with regard to FIGS. 3A and 3B. Since electrons with different energy are now separated in time it is expected that fast electrons with higher energy will arrive to the detector first. Depending on the required energy resolution the detector will be "open for counting" for a particular period of time during which counting or signal integration will occur. The materials at the location of interest 100 then can be identified by comparing the electron emission spectrum (Auger-spectrum) to standard tables, which can include tables, graphs, charts, indices, and the like, with data for known materials.

In the present embodiment, detector 118 is configured to detect electrons emitted by area of interest 100. In some embodiments, detector 118 can include other functions or can be combined with or used alongside other devices. For instance, detector 118 can be combined with an x-ray detector. As described above, x-ray detectors can efficiently detect x-rays from materials having high atomic numbers, and electron detectors can efficiently detect electrons from materials having low atomic numbers. By combining an electron detector with and x-ray detector, a more comprehensive analysis of the materials included an area of interest 100 can be performed.

As mentioned above, charged particle device 102 can emit charged particle beam 104 in short pulses in some embodiments. For instance, a short pulse can be emitted from charged particle device 102, and after the electrons emitted from area of interest 100 reach detector 118, another short pulse can be emitted from charged particle device 102. This process of emitting short pulses can continue until enough data about the emitted electrons is obtained. Pulsed beams are typically necessary in time-of-flight measurements in order to synchronize the data collection with the data generation. In those cases the pulses are used as triggers for the detection electronics. Typically, the charged particle device is configured to emit the charged particle beam in short pulses. In one embodiment a suitably configures device 102 is configured to emit the charged particle beam with a frequencies in the range of about 0.1 KHz to about 100 MHz.

As shown and described in the present embodiment, objective lens 108, redirecting lens 110, and focusing lens 112 are configured to collect a wide spectrum of electrons emitted from area of interest 100. By placing these lenses in the configuration shown, more electrons can be collected than if the conventional techniques, such as EDS, are used. Furthermore, the present configuration allows more electrons to be collected than if a drift tube were placed adjacent to the area of interest 100 because only a fraction of the emitted electrons would be collected, as is the case in typical time of flight spectrometry systems used for applications unrelated to semiconductor testing.

The effective solid angle for electron collection, due to the high extraction field, is 180 degrees for a very wide range of electron momentum vectors. This solid angle is significantly larger than any detector system placed outside the lens. It is of high importance however, that the high extraction efficiency (solid angle) does not alter the timing information (energy information) of the electrons. Although various components are shown in the present embodiment, it should be recognized that various modifications can be made within the scope of the present invention.

Figure 3A:
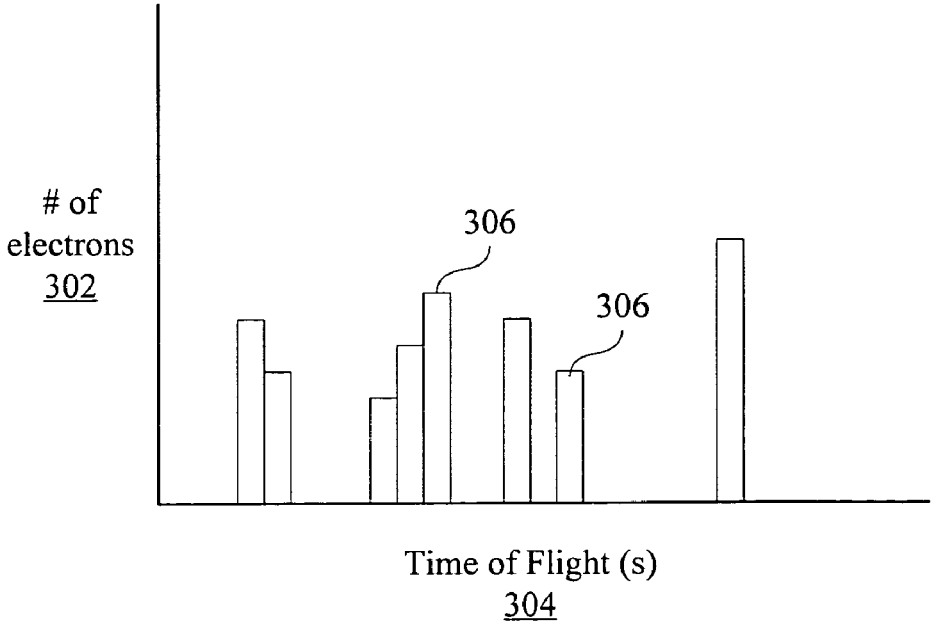
FIGS. 3A and 3B are exemplary electron emission spectrum graphs.
Figure 3B:
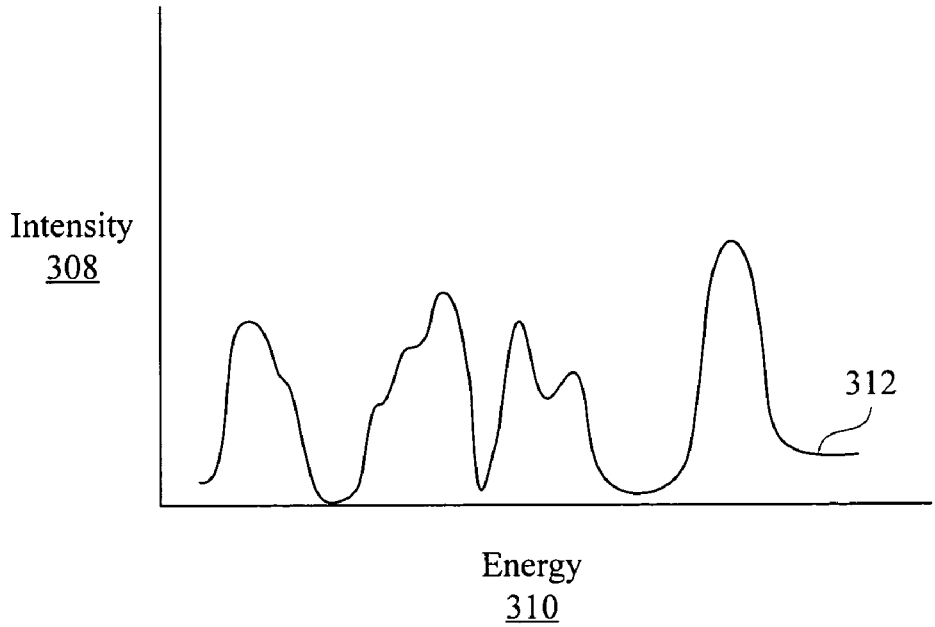

With reference to FIGS. 3A and 3B, shown are exemplary electron emission spectrum graphs that can be constructed by computing module 122 (FIG. 2). In particular, FIG. 3A shows a graph of the number of electrons 302 versus the time of flight 304 through drift tube 116. Specifically, if ten electrons have a time of flight between 10 and 11 nanoseconds, the graph can show a bar 306 having a height of ten units at a location along axis 304 between 10 and 11 nanoseconds. Furthermore, if seven additional electrons have a time of flight between 15 and 16 nanoseconds, the graph can show a bar 306 having a height of seven units at a location along axis 304 between 15 and 16 nanoseconds. In this manner a bar graph or curve can be constructed to represent an electron emission spectrum for an area of interest 100.

From the time of flight information included in FIG. 3A, a graph of the intensity versus energy can be constructed. FIG. 3B shows a graph of the intensity 308 of the electrons having energy 310. More particularly, the time of flight information included in FIG. 3A can be converted to a measure of kinetic energy, a set forth in the following equation:

$$E = \frac{1}{2}mv^2 = \frac{1}{2}m\left(\frac{L}{t}\right)^2,$$

where E=kinetic energy, m=mass of an electron, L=length of drift tube 116, and t=time of flight for an electron passing through drift tube 116 (as measured by detector 118 and computing module 122). This equation is valid when the time-of-flight of the electrons inside the system is much smaller than inside the drift tube. The graph then can be plotted as a function of the intensity of electrons having a particular kinetic energy to provide curve 312. The electrons are accelerated to high energy before the drift tube and decelerated to very low energy inside he drift tube. With a typical drift tube length of 50 cm and electron energy of 10 eV a total capture window of a few hundred nanosecond can be used. With this drift tube length, 1 eV energy separation corresponds to 10 ns time separation. The time spread due to the travel of the electrons outside the drift tube is negligible compared to the time separation mentioned above.

The peaks on curve 312 typically correspond to materials having "characteristic" kinetic energy peaks. Accordingly, the energies corresponding to the peaks can be compared to standard tables, which can include tables, graphs, charts, indices, and the like, with characteristic energy peak data for known materials, as described above. For instance, if a peak is found at 277 eV, then a material known to have a characteristic peak at 277 eV, such as carbon, can be identified in a standard table. This material can be identified as a material included at area of interest 100.

Figure 4:
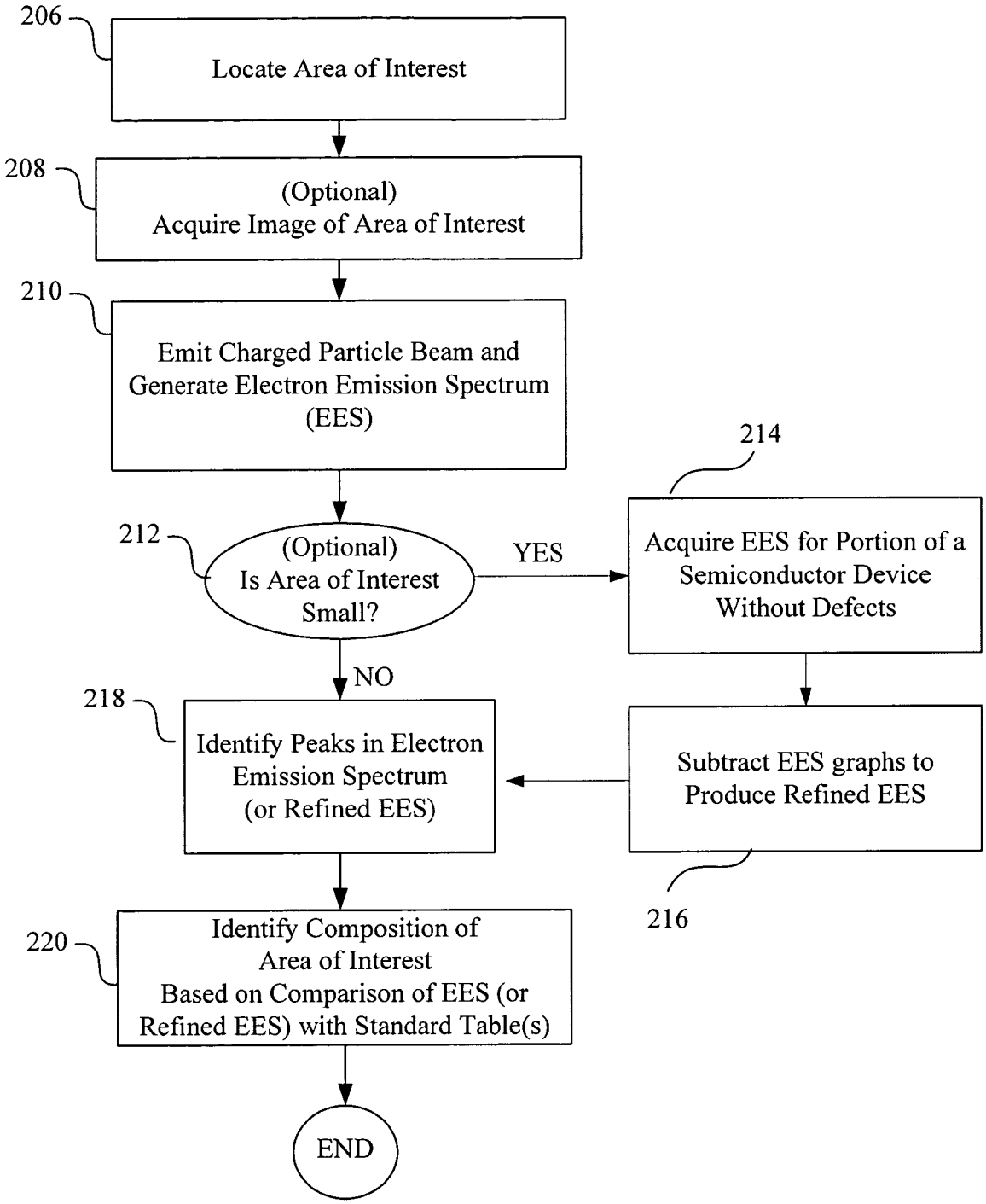
FIG. 4 is an exemplary process flow diagram depicting a process for identifying the composition of the materials at an area of interest on a semiconductor device.

With reference to FIG. 4, shown is an exemplary process for identifying the composition of an area of interest on a semiconductor device. Generally, as describe above, testing of a semiconductor device occurs in two phases. First, during the "inspection" phase of testing, semiconductor devices are inspected and areas of interest 100 (FIG. 2), such as defects or potential defects, can be detected during this phase. Semiconductor devices having defects or potential defects at areas of interest 100 are then set aside for further testing. Second, during the "review" phase of testing, the semiconductor devices that have been set aside are then studied to determine the characteristics of the area of interest 100, such as the material composition of the area of interest 100. Identifying these characteristics can be helpful in determining how the area of interest 100 was created. Furthermore, if area of interest 100 is a defect, this information can be helpful in determining how to prevent defects in the future.

In the present embodiment, the process described generally involves the "review" phase of testing. At 206, the area of interest 100 can be located on semiconductor device 101 (FIG. 2). More particularly, semiconductor device 101 can be positioned with respect to charged particle device 102 (FIG. 1). Next, an inspection file having general location information for the area of interest 100 can be loaded into a computer associated with the charged particle device 102. This computer can be computing device 122 (FIG. 2) or a separate computer, and can be configured to position the charged particle beam 104 with respect to area of interest 100. Although computing device 122 is shown with a connection to detector 118, computing device 122 can also have a connection to charged particle device 102, or other devices, depending on the application.

The inspection file is generated during the "inspection" phase of testing and can be used to identify the general location where charged particle beam 104 should be directed during the "review" phase. Next, using the general location information, an image of the area of interest 100 can be acquired, along with a reference image of a similar or identical portion of a semiconductor device without defects or other irregularities. In order to obtain more specific location information for the area of interest, one of the two images can be subtracted from the other to provide an image that emphasizes the differences between the two images. For instance, the reference image can be subtracted from the image of the area of interest to identify this more specific location, or vice versa. This information can then be used to identify a more specific location for the area of interest 100, such as where the center of the area of interest 100 is located.

Figure 5:
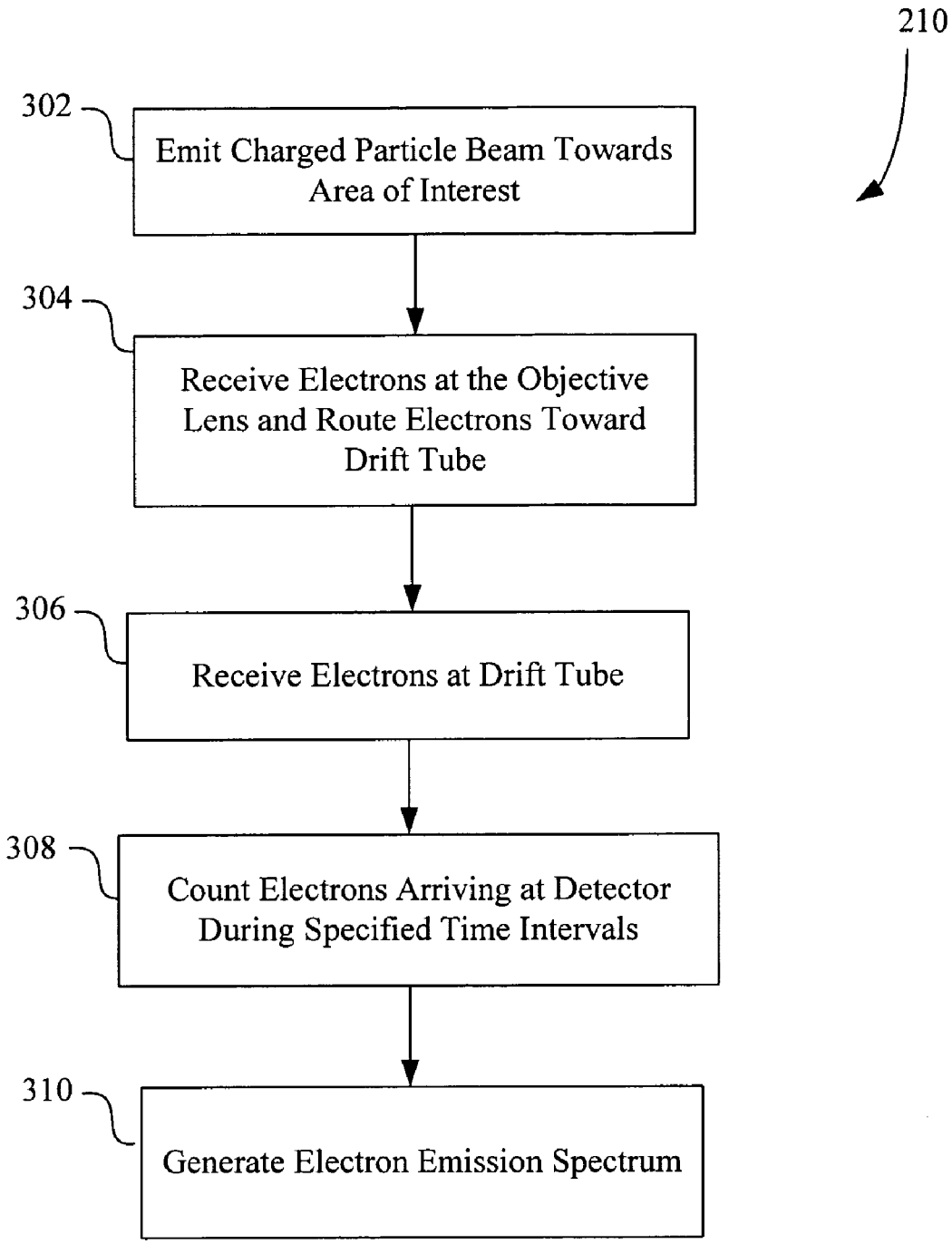
FIG. 5 is an exemplary process flow diagram depicting a process for generating an electron emission spectrum.

Next, at 208, a higher resolution image of the area of interest can be acquired based on the specific location identified at 206. This higher resolution image can be used to obtain geometry and topography information of the defect for visual or automated classification. This image, however, will not contain quantitative material information. Once the defect is positioned, then a charged particle beam 104 can be emitted towards area of interest 100 and an electron emission spectrum can be generated. See block 210. More details about block 210 are included in the process of FIG. 5. With reference to FIG. 5, a charged particle beam 104 can be emitted towards area of interest 100. See 302. Next, as described above with regard to FIG. 2, once charged particle beam 104 reaches area of interest 100, electrons emitted from area of interest 100 can pass through objective lens and be routed to drift tube 116 via various lenses. See 304. Although particular lenses are described in conjunction with FIG. 2, it should be recognized that these lenses can be modified within the scope of the present intention, as described above. For instance, additional lenses can be used, or some of the lenses can be combined or removed, depending on the application. Once the electrons 106 reach drift tube 116, the electrons can pass through drift tube 116. See 306. Upon reaching the detector 118 at or near the end of drift tube 116, the electrons 106 can be counted or integrated. See 308. Next, computing module 122 can generate an electron emission spectrum, as described in more detail above with regard to FIGS. 2 and 3. See 310.

Returning to FIG. 4, once an electron emission spectrum is generated, then in some embodiments, a determination is made as to whether material signatures of interest is smaller than a specified threshold. If a defect is small, then peaks in the electron emission spectrum corresponding to the materials at the area of interest 100 may be small and therefore difficult to identify. In this case an electron emission spectrum can be acquired from an identical section of a semiconductor device without defects in a manner similar to that described above with regard to FIGS. 2 and 3. See 214. This will constitute the background spectrum. Next, one of the electron emission spectrums obtained at 210 or 214 can be subtracted from the other electron emission spectrum to produce a refined electron emission spectrum that more particularly identifies the portions of the spectrum that correspond to the area of interest 100, and not the surrounding areas of the semiconductor device 101. See 216. For instance, the electron emission spectrum for the semiconductor device without defects can be subtracted from the electron omission spectrum for the area of interest 100, or vice versa. If the signal from the area of interest is not smaller than a specified threshold, then the process continues with block 218. As indicated, blocks 212, 214, and 216 are optional. However, this sequence of optional blocks can be useful in applications where small defects or other areas of interest are expected during the review process.

Next, at 218, peaks in the electron emission spectrum (or the refined electron emission spectrum, if obtained) can be identified, as described in more detail above with regard to FIG. 2. The energies corresponding to these peaks can then be compared with standard tables for known materials to identify the material composition of the area of interest 100, as also described above with regard to FIG. 2. This information can be used to determine the characteristics of the area of interest and identify any problems in the semiconductor device fabrication process. For instance, based on the materials found at an area of interest 100, it can be concluded that the deposition process is defective because the area of interest 100 includes exposed layers that should be covered by the deposition of another material.

The techniques of the present invention provide various benefits for testing semiconductor devices. In particular, the techniques of the present invention improve upon signal collection techniques. Specifically, a greater number of the electrons emitted from an area of interest can be detected, thereby providing a broader spectrum of the electrons emitted by the area of interest. In some embodiments, substantially all of the electrons can be detected, thereby providing an even broader spectrum of the electrons emitted by the area of interest. Furthermore, a broader range of electrons emitted in response to a single pulse can be detected, thereby reducing the amount of time needed to obtain an electron emission spectrum. For instance, the techniques of the present invention allow identification of materials at an area of interest on the order of about 10 seconds, in contrast to the 10 minutes that it typically takes to perform EDS for an area of interest. As compared to traditional mass spectrometry systems that have been applied outside the field of semiconductor testing, which typically measure time of flight on the order of microseconds, the techniques of the present invention measures time of flight on the order of nanoseconds. Yet another benefit of the techniques of the present invention is that the apparatus and process described can be used in conjunction with current testing equipment. Accordingly, current semiconductor testing systems can be retrofitted with the features described in this application without requiring substantial alteration or costs to the current processes employed or the equipment used.

Although the above generally describes the present invention according to specific exemplary processes and apparatus, various modifications can be made without departing from the spirit and/or scope of the present invention. Therefore, the present invention should not be construed as being limited to the specific forms shown in the appended figures and described above.

What is claimed is:

1. An apparatus for determining the energy of electrons emitted from a semiconductor device at an area of interest comprising:

a charged particle device configured to emit a charged particle beam towards the area of interest such that electrons are caused to emanate from the area of interest and such that the charged particle beam forms a path;

a redirecting lens disposed in the path of the charged particle beam, wherein the redirecting lens is configured to allow the charged particle beam to travel towards the area of interest, and wherein the redirecting lens is configured to direct electrons that emanate from the area of interest away from the path of the charged particle beam;

an electron time-of-flight spectrometer disposed adjacent to the redirecting lens, wherein the electron time-of-flight spectrometer is configured to receive the electrons directed from the redirecting lens; and a computing module coupled to the electron time-of-flight spectrometer for counting and determining the time of flight for each of the electrons received by the electron time-of-flight spectrometer.

2. An apparatus as recited in claim 1 wherein the electron time-of-flight spectrometer is a drift tube, wherein the drift tube includes an aperture configured to receive the electrons directed from the redirecting lens; and at least one detector disposed within the drift tube in order to detect the electrons traveling through the drift tube.

3. An apparatus as recited in claim 1 wherein the computing module is configured to produce an electron emission spectrum for the materials at the area of interest, whereby the composition of the materials can be determined.

4. An apparatus of claim 1 further comprising:

an objective lens positioned between the semiconductor device and the drift tube, the objective lens configured to attract and collimate the electrons that emanate from the area of interest.

5. The apparatus of claim 1, further comprising:

an objective lens disposed between the redirecting lens and the area of interest, wherein the objective lens is configured to direct the charged particle beam toward the area of interest, and wherein the objective lens is configured to direct the electrons that emanate from the area of interest towards the redirecting lens.

6. An apparatus of claim 5 wherein the objective lens is an image-forming lens.

7. An apparatus of claim 5 wherein the objective lens includes a combination magnetic and electrostatic lenses configured to generate an electrostatic field with a negative potential such that substantially all electrons that emanate from the area of interest are drawn towards the objective lens, and wherein the negative charge of the objective lens is of a lesser magnitude than a negative charge of the area of interest.

8. An apparatus of claim 1 wherein the redirecting lens is an electrostatic or a magnetic lens.

9. An apparatus of claim 1, further comprising:

a focusing lens disposed between the redirecting lens and the aperture of the drift tube, wherein the focusing lens is configured to focus electrons from the redirecting lens through the aperture of the drift tube.

10. An apparatus of claim 9 wherein the focusing lens is an Einzel lens.

11. An apparatus of claim 1, wherein the redirecting lens is a Wien filter or a triple magnetic/electrostatic deflector.

12. An apparatus of claim 1, wherein the computing module is further configured to determine the energy associated with each of the electrons based on the time of flight for each of the electrons through the drift tube to produce the electron emission spectrum.

13. An apparatus of claim 12, wherein the computing module is further configured to identify the materials associated with the area of interest by comparing the energies corresponding to peaks in the electron emission spectrum with standard tables for known materials.

14. An apparatus of claim 1 wherein the charged particle device is configured to emit the charged particle beam in short pulses.

15. An apparatus of claim 1 wherein the charged particle device is configured to emit the charged particle beam with a frequency in the range of about 0.1 KHz to about 100 MHz.

16. An apparatus of claim 1 wherein the electrons that emanate from the area of interest have energies in the range of about 0 eV to about 35000 eV.

17. An apparatus of claim 2 wherein the drift tube further comprises a negative energy grid configured to decrease the speed of electrons traveling through the drift tube.

18. An apparatus of claim 17 wherein the negative energy grid includes parallel plates, a cylindrical section, or a spherical section that generates an electromagnetic field within a region of the drift tube.

19. An apparatus of claim 1 further comprising an x-ray detector configured to detect x-rays emitted by the area of interest in response to the charged particle beam.

20. A method for determining the material composition of a semiconductor device at an area of interest comprising:

locating the area of interest on the semiconductor device;

emitting a charged particle beam towards the area of interest such that electrons are caused to emanate from the area of interest;

directing the electrons that emanate from the area of interest away from the path of the charged particle beam such that the electrons are directed toward a drift tube;

receiving the electrons through an aperture of the drift tube;

detecting the electrons arriving at a detector disposed opposite the aperture of the drift tube during specified time intervals;

calculating a time of flight for each of the electrons arriving at the detector;

generating an electron emission spectrum for the electrons from the time of flight calculations;

identifying peaks in the electron emission spectrum; and identifying the materials associated with the area of interest by comparing the energies corresponding to the peaks in the electron emission spectrum with standard tables for known materials.

21. The method of claim 20 wherein emitting the charged particle beam includes pulsing the charged particle beam.

22. The method of claim 20 wherein locating the area of interest includes:

positioning the area of interest with respect to a charged particle device configured to emit the charged particle beam towards the area of interest;

loading an inspection file, wherein the inspection file includes a general location of the area of interest based on a manual inspection of the semiconductor device;

acquiring a reference image of a similar or identical portion of a semiconductor device without irregularities;

acquiring a first image of the area of interest based on the general location specified in the inspection file, and subtracting the reference image from the first image of the defect or subtracting the first image from the reference image to identify the specific location of the defect.

23. The method of claim 22 further comprising acquiring a second image of the defect based on the specific location of the defect, wherein the second image has a higher resolution of the defect than the first image.

24. The method of claim 20 further comprising:

generating an electron emission spectrum for a similar or identical portion of a semiconductor device without irregularities;

subtracting the electron emission spectrum for the portion of the semiconductor device without irregularities from the electron emission spectrum for the area of interest or subtracting the electron emission spectrum for the area of interest from the electron emission spectrum for the portion of the semiconductor device without irregularities to produce a refined electron emission spectrum, wherein identifying peaks in the electron emission spectrum includes identifying peaks in the refined electron emission spectrum, and wherein identifying the materials at or near the defect includes identifying the materials by comparing the peaks in the refined electron emission spectrum with standard tables for known materials.

25. The method of claim 24 wherein the refined electron emission spectrum is produced if it is determined that the defect is smaller than a specified size.

26. The method of claim 25 wherein the determination is made based on features of the generated electron emission spectrum, the first image, or a second image having a higher resolution of the defect than the first image.

27. The method of claim 20 wherein the electron emission spectrum is a graph of the number of electrons versus time of flight through the drift tube or a graph of the intensity of the emitted electrons versus the energy of the emitted electrons.

28. An apparatus for determining the energy of electrons emitted from a semiconductor device at an area of interest comprising:

a charged particle device configured to emit a charged particle beam towards the area of interest such that electrons are caused to emanate from the area of interest;

a spectrometer that receives the electrons that emanate from the area of interest;

at least one detector that detects the electrons received by the spectrometer;

an objective lens positioned between the semiconductor device and the spectrometer, the objective lens configured to attract and collimate the electrons that emanate from the area of interest and wherein the objective lens is configured to attract and collimate substantially all of the electrons that emanate from the area of interest; and a computing module coupled to the detector, wherein the computing module is configured to determine the energy and intensity of the electrons received by the spectrometer.

29. An apparatus as recited in claim 28 wherein the objective lens includes a magnetic and an electrostatic lens.

30. An apparatus as recited in claim 28 wherein the objective lens is configured to generate an electrostatic field having negative potential such that substantially all electrons that emanate from the area of interest are drawn towards the objective lens, wherein the negative charge of the objective lens is of a lesser magnitude than a negative charge of the area of interest.

31. An apparatus as recited in claim 28 wherein the spectrometer is a drift tube that includes an aperture configured to receive the electrons that are attracted to and collimated by the objective lens.

32. An apparatus as recited in claim 28 further comprising:

a redirecting lens disposed between the objective lens and the charged particle device, the redirecting lens is configured to allow the charged particle beam to travel towards the area of interest and wherein the redirecting lens is configured to direct electrons that are attracted to the objective lens towards the spectrometer.

33. An apparatus for determining the energy of electrons emitted from a semiconductor device at an area of interest comprising:

a charged particle device configured to emit a charged particle beam towards the area of interest such that electrons are caused to emanate from the area of interest and such that the charged particle beam forms a path;

an objective lens disposed in the path of the charged particle beam, wherein the objective lens is configured to allow the charged particle beam to travel towards the area of interest, and wherein the objective lens is further configured to enable electrons emanating from the area of interest to be directed away from the area of interest and toward a redirecting lens as an electron beam;

a redirecting lens disposed in the path of the charged particle beam and in the path of the electron beam, the lens configured to redirect the electron beam toward a focusing lens;

the focusing lens configured to focus the redirected electron beam on a detector system;

the detector system including an electron time-of-flight spectrometer arranged to receive the focused electron beam from the focusing lens; and a computing module coupled to the electron time-of-flight spectrometer for counting and determining the time of flight for each of the electrons received by the electron time-of-flight spectrometer.

34. An apparatus as in claim 33 wherein the objective lens is configured to attract and collimate substantially all of the electrons that emanate from the area of interest.

35. An apparatus as in claim 33 wherein the electron time-of-flight spectrometer is arranged at a greater distance from the area of interest than the objective lens.

* * * * *